US005257928A

United States Patent [19]

Harding

[11] Patent Number: 5,257,928

[45] Date of Patent: Nov. 2, 1993

[54] RIDER FOR FURNACE SUPPORT

[75] Inventor: Hugh J. Harding, McMurray, Pa.

[73] Assignee: SSE International Corporation, Bridgeville, Pa.

[21] Appl. No.: 856,288

[22] Filed: Mar. 23, 1992

[51] Int. Cl.[5] ..... F23D 13/06

[52] U.S. Cl. ..... 432/234; 432/235; 432/122

[58] Field of Search ..... 432/234, 235, 122

[56] References Cited

U.S. PATENT DOCUMENTS 4,505,303 3/1985 Revere et al. ..... 432/234
4,609,347 9/1986 Yamashita et al. ..... 432/234
4,689,009 8/1987 Heuss ..... 432/235
4,900,248 2/1990 Terai et al. ..... 432/234
4,906,525 3/1990 Seguchi et al. ..... 432/234

*Primary Examiner*—Henry C. Yuen
*Attorney, Agent, or Firm*—Harry B. Keck

[57] ABSTRACT

A rider for use with lengthwise generally horizontal supports in a furnace is formed from an anchor block and a cover block and a locking means. The anchor block is secured to the lengthwise generally horizontal support surface. The cover block fits vertically onto the anchor block and can be moved forwardly into a locking position which prevents vertical, forward, or lateral movement of the cover block. A locking means between the anchor block and the cover block prevents rearward movement of the cover block. The cover block is replaceable without requiring removal and replacement of the anchor block.

11 Claims, 3 Drawing Sheets 15
17a
17b
17c
13
14
11
12
10

RIDER FOR FURNACE SUPPORT

BACKGROUND OF THE INVENTION

1. Field of the Invention

The present invention concerns an improved rider for a lengthwise generally horizontal support member in a furnace, and more particularly to a rider having a cover block, an anchor block and a locking means.

2. Description of the Prior Art

Furnaces for heating steel plates and billets are generally pushing furnaces or walking beam furnaces. The furnace is a heated chamber with radiant and convective heat sources. The workpieces are advanced through the pusher furnace in sequence with the forward end of each workpiece pushing the rear end of the preceding workpiece. The workpieces are supported above the floor of the furnace by lengthwise generally horizontal support members which are customarily water cooled. Relatively small support blocks, called riders, are secured to the top of the support members to prevent direct contact between the workpieces and the support members. Such furnaces are described in U.S. Pat. No. 4,353,690; the lengthwise generally horizontal supports are described in U.S. Pat. No. 4,290,457. Typical riders are described in U.S. Pat. No. 4,056,351.

The riders normally are formed from heat resistant steel, e.g., steel having a high content of cobalt, nickel, chromium, tungsten, molybdenum, titanium, vanadium or nitrogen. The riders typically are welded directly or indirectly (by means of keys which are welded) to the lengthwise generally horizontal supports. The riders tend to abrade and deteriorate over the lifetime of a furnace. Replacing riders is a difficult and costly operation, requiring that the furnace be cooled and kept out of service for extended periods of time. Replacement of each rider requires removal of the worn rider by removing the weld or welds customarily employed to secure the riders to the lengthwise generally horizontal supports. The replacement rider thereafter is welded directly or indirectly to the lengthwise generally horizontal support.

STATEMENT OF THE PRESENT INVENTION

An improved rider of this invention is formed from two blocks and a locking means. The first block is an anchor block which is secured directly to a lengthwise generally horizontal support preferably by welding. The second block is a cover block which is wider, longer and higher than the anchor block and has a bottom opening chamber to permit the cover block to fit over the secured anchor block and to slide forwardly into a position wherein interlocking elements of the two blocks prevent vertical separation of the coverplate from the lengthwise generally horizontal support and wherein appropriate bearing surfaces within the cover block chamber abut corresponding bearing surfaces of the anchor block to preclude forward movement of the cover block in operation. A locking means is provided which can be moved from a first alternative position in which it is retained within the anchor block to a second alternative position in which the locking means moves into a locking chamber which is created after the cover block is moved forwardly with respect to the anchor block into an operative position. In a preferred embodiment, the locking means comprises a magnetic sphere or cylinder which can be magnetically attracted and withdrawn from the locking chamber back into a recess in the anchor block to permit the cover block to slide rearwardly with respect to the anchor block and to be separated from the anchor block.

An advantage of the described rider construction is that the coverplate can be fabricated from relatively costly heat resistant steel such as high cobalt steel, whereas the anchor block can be fabricated from less costly materials. A further advantage is that the rider elements can be reconstructed by simply replacing the cover blocks without requiring removal, clean-up and replacement of the anchor block.

These and other advantages of the invention will become apparent from the following detailed description with particular reference to the drawings.

DESCRIPTION OF THE PREFERRED EMBODIMENTS

Figure 1:
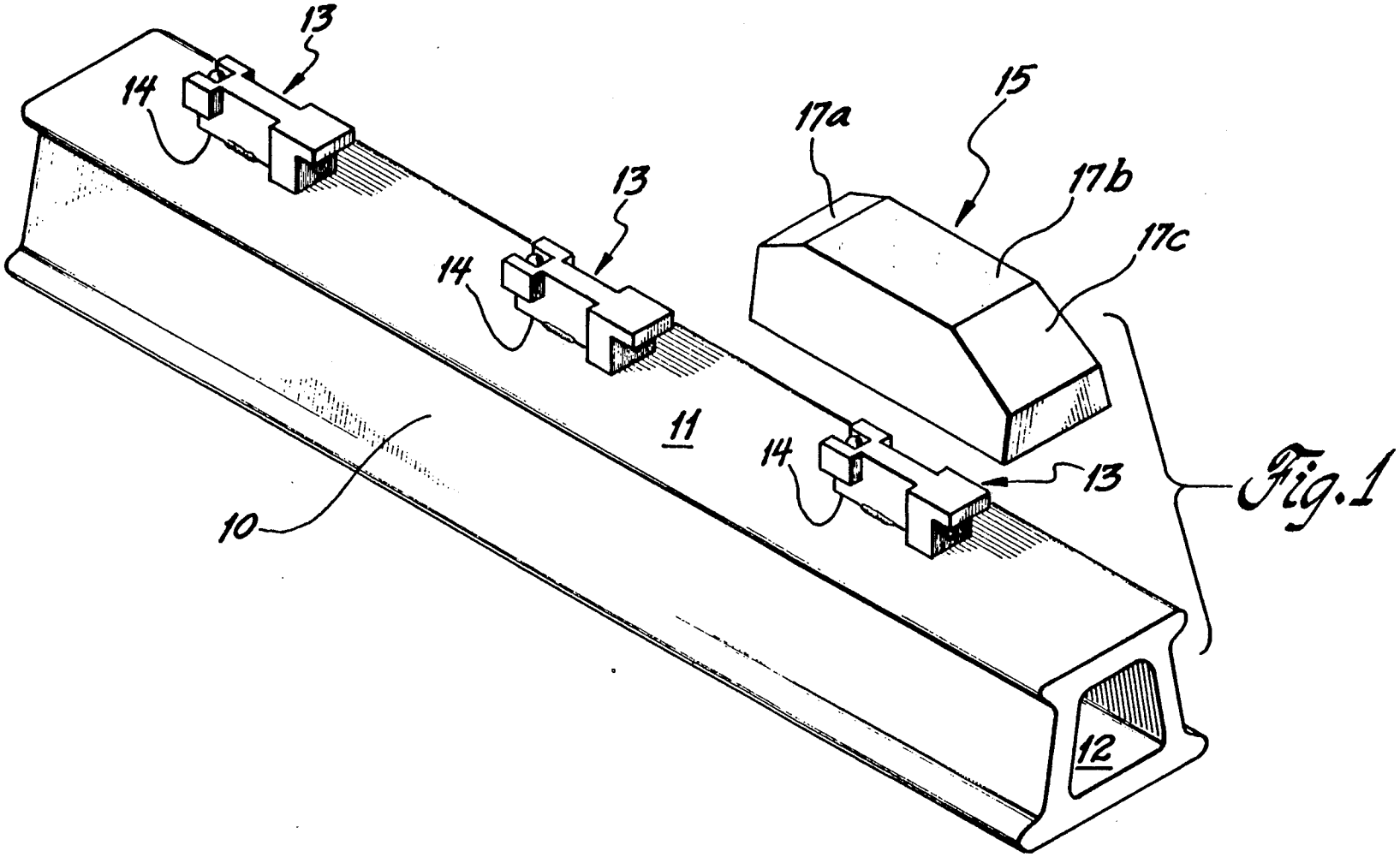
FIG. 1 is a fragmentary schematic illustration of a lengthwise generally horizontal support in a furnace with three anchor blocks of the present invention illustrated in their operative position.

FIG. 1 illustrates a typical lengthwise generally horizontal support 10 which is similar to that illustrated in U.S. Pat. No. 4,290,457. The support has a flat, generally horizontal upper surface 11 and a passageway 12 which is suitable for conducting a cooling fluid.

A number of anchor blocks 13 are secured to the top surface 11, preferably by welding along bottom edges 14. It should be noted that an unseen bottom edge, corresponding to the visible bottom edge 14 is presented by the unseen face of each anchor block 13.

A cover block 15 is provided for each anchor block 13, although only one cover block 15 is illustrated in FIG. 1. The cover block 15 has a bottom opening chamber 16 (FIG. 3) which permits the cover block 15 to slide vertically downwardly onto the anchor block 13 and thereafter to slide forwardly as will be more fully described hereinafter.

The top surface of the cover block 15 has multiple facets 17*a*, 17*b*, 17*c*. A generally horizontal surface 17*b* as intended to engage workpieces as the workpieces proceed through a furnace. The sloping surface 17*c* provides a ramp to facilitate advance of workpieces into engagement with the horizontal surface 17*b*. The sloping surface 17*a* provides a smooth separation of each supported workpiece (not shown) and the rider cover block 15.

Figure 2:
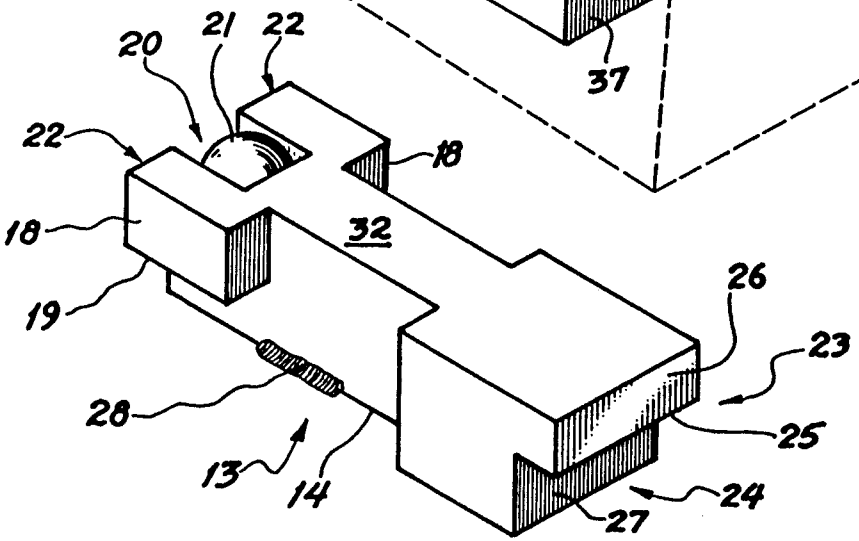
FIG. 2 is a schematic illustration of an anchor block.

As shown in FIG. 2, laterally extending bosses 18 are positioned at the forward top portion of the anchor block 13. The under surfaces 19 of the laterally extending bosses 18, are generally horizontal surfaces which constitute a first hold down means. A forward opening top recess 20 to receives a locking device, illustrated as a sphere 21. It will be observed that the anchor block 13 has a forward portion 22 and a rear portion 23.

A transverse bottom recess 24 is provided at the bottom rear portion 23 of the anchor block 13. The recess 24 provides a generally horizontal second hold down surface 25. The rear portion 23 of the anchor block 13 presents generally vertical surfaces 26, 27. Either or both of the surfaces 26, 27 may be a bearing wall. Preferably only the lower surface 27 is a bearing wall. The anchor block 13 is secured to a support (not shown) by means of appropriate welds such as the weld 28 along a bottom edge 14 of the anchor block 13.

The Cover Block

Figure 4:
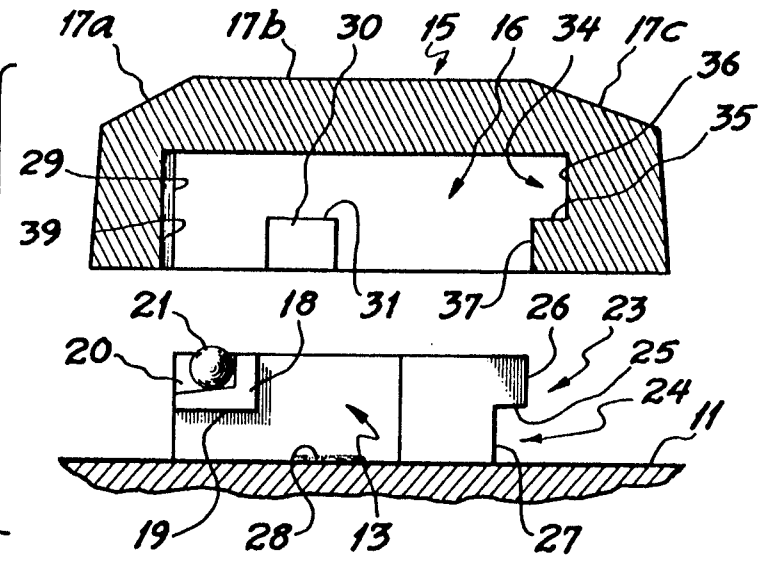
FIG. 4 is a cross-section illustration of a cover block and an anchor block and locking means taken along the vertical center lengthwise plane of those elements prior to engagement of the anchor block and the cover block.
Figure 5:
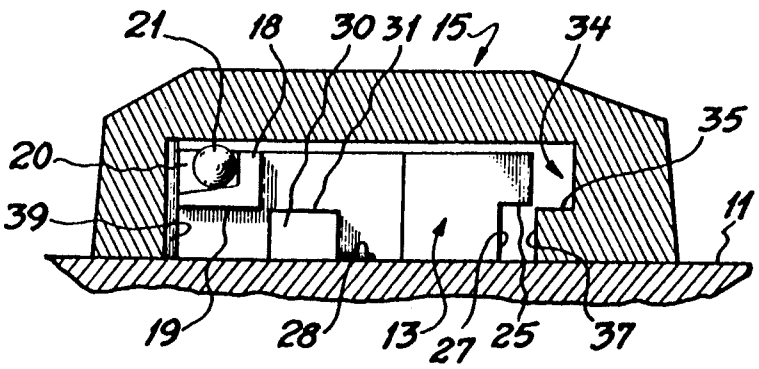
FIG. 5 is a cross-section illustration taken along the vertical center lengthwise plane of the rider with the cover block in covering relation to the anchor block.

The cover block 15 is longer, wider and higher than the anchor block 13. A bottom opening chamber 16 in the cover block 15 includes inwardly extending bosses 30 which present generally horizontal surfaces 31 which are adapted to engage the first hold down surfaces 19 of an anchor block 13. The distance between the inwardly extending bosses 31 corresponds to the width of the neck 32 of the anchor block 13 to preclude lateral movement of the cover block 15. The rear portion 33 of the chamber 16 has a transverse recess 34 which presents a generally horizontal surface 35 adapted to engage the second hold down surface 25 of the anchor block 13. The transverse recess 34 also presents a generally vertical wall 36 which confronts the vertical wall 26 of the anchor block 13. The walls 36, 26 are preferably spaced-apart, as shown, although the walls may abut and function as bearing walls. A second generally vertical bearing wall 37 is engageable with the bearing wall 27 of the anchor block 13. The distance between the rearward surfaces of the inward bosses 31 and the bearing wall 37 corresponds to the length of the anchor block at the top of its rear portion 23. Thus the cover block 15 has sufficient clearance to drop onto the anchor block vertically as can be seen in FIGS. 4 and 5. In normal operation, the base of the cover block 15 will engage the top surface 11 of a lengthwise, generally horizontal support.

Figure 3:
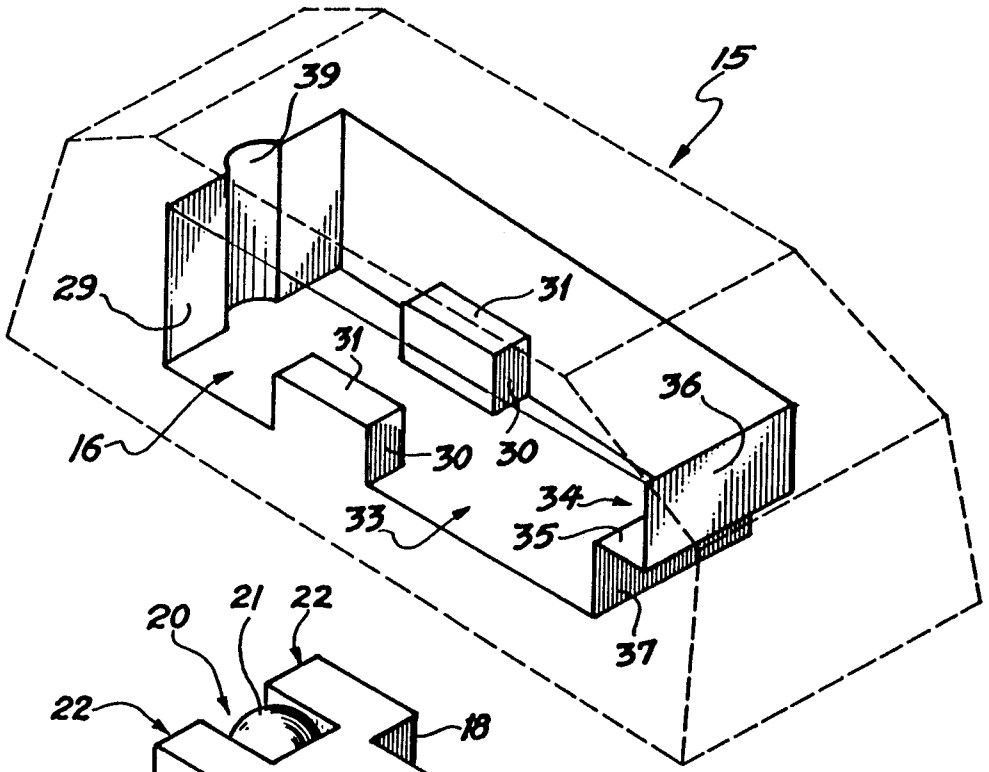
FIG. 3 is a schematic illustration of a cover block.
Figure 6:
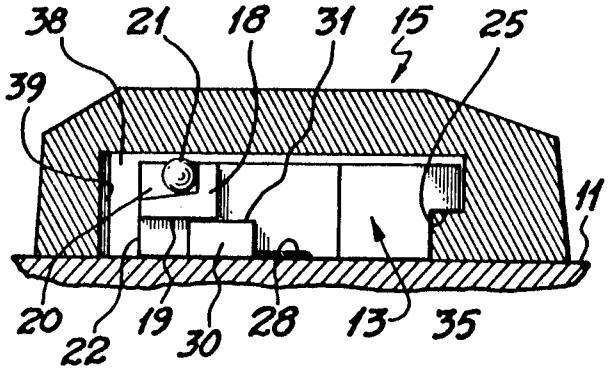
FIG. 6 is a cross-section illustration of the rider taken along the vertical center lengthwise plane after the cover block has been moved forwardly with respect to the anchor block.
Figure 7:
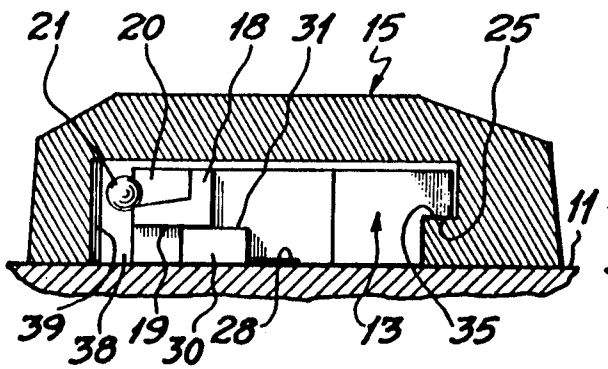
FIG. 7 is a cross-section illustration, similar to FIG. 5, with the locking member illustrated in a passageway between the anchor block and the cover block.
Figure 8:
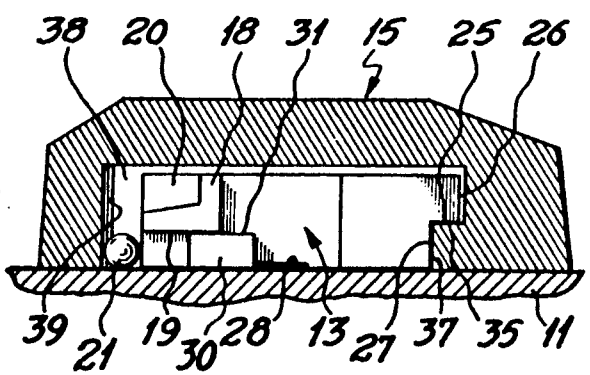
FIG. 8 is a cross-section illustration, similar to FIGS. 6 and 7, with the locking means positioned in a locking chamber between the anchor block and the cover block.

The cover block 15 slides forwardly (from right to left) in FIGS. 6, 7, 8; the generally horizontal surfaces 25, 35 engage; and the generally horizontal surfaces 19, 31 engage to prevent vertical movement of the cover block 15 away from the generally horizontal support surface 11. As the cover block 15 is advanced, a locking means chamber 38 is established in front of the forward end 22 of the anchor block 13. A passageway (unnumbered) exists between the recess 20 and the locking chamber 38 to permit the locking means 21 to move from the recess 20 into the locking chamber 38. With the locking means 21 in the position illustrated in FIG. 8, the cover block 15 cannot be retracted with respect to the anchor block 13. The locking means 21 preferably is a sphere having a diameter greater than the locking chamber dimension between the vertical wall 22 and the forward inner wall 29 (FIG. 3). A central groove 39 in the inner wall 29 accommodates a spherical locking means 21 and retains the locking means 21 in the central region of the locking chamber 38.

Thus the rider of this invention presents a top surface 17 in contact with a workpiece (not shown) moving through a furnace. The cover block 15 is fabricated from appropriate heat resistance steel such as high cobalt content steel whereas the anchor block 13 preferably is fabricated from less costly materials, preferably oxidation-resisting steel.

Replacement of the rider requires merely removal and replacement of the cover block 15. There is no need to remove, clean-up or replace the anchor block 13.

In a preferred embodiment, the locking means 21 is a sphere or a cylinder plug which can readily roll by means of gravity from the recess 20 into the locking chamber 38. If the locking means 21 is formed from magnetic steel, the locking means may be removed with an external magnet from the locking chamber 38 and replaced in the recess 20 when it is desirable to replace a rider coverplate 15. With the locking means 21 restored to the recess 20, the coverplate 15 may be moved rearwardly from the position of FIG. 8 to the position of FIG. 5.

BEST MODE

The best mode of the invention comprises an anchor block 13 and a cover block 15 as illustrated in FIGS. 1, 2, 3. A suitable cover block 15 is about 6 to 20 inches long, about 3 to 12 inches high and about 3 to 10 inches wide. Preferably the side walls of the cover block 15 are sloping so that the top surface **17*b*** is narrower than the base of the cover block.

I claim:

1. A heat resistant rider for supporting a workpiece in a furnace having lengthwise, generally horizontal supports, said rider comprising:

an anchor-block secured to a said lengthwise, generally horizontal support; a heat-resistant cover block having a bottom-opening chamber adapted to receive said anchor-block;

means to resist vertical movement, means to resist lateral movement, means to resist forward movement and locking means to resist rearward movement of said cover-block in relation to said lengthwise, generally horizontal support.

2. A rider according to claim 1 wherein said means to resist vertical movement includes hold-down means on said anchor-block and corresponding hold-down means in said bottom-opening chamber.

3. A rider according to claim 2 wherein said hold-down means on said anchor-block is a first generally horizontal surface extending laterally from said anchor-block, and wherein said hold-down means in said bottom-opening chamber is a second generally horizontal surface extending inwardly from a wall of said bottom-opening chamber, said first and second surfaces being engagable.

4. A rider according to claim 1 wherein said means to resist forward movement comprises a generally vertical, flat transverse, flat first bearing surface of the rear portion of said anchor-block, and a generally vertical, flat, transverse second bearing surface at the rear of said bottom-opening chamber, said first bearing surface and said second bearing surface being engagable.

5. A rider according to claim 1 wherein said means to resist rearward movement comprises a locking element which is positioned between and engaged with a forward wall of said anchor-block and a forward wall of said bottom-opening chamber.

6. A heat-resistant rider for supporting a workpiece in a furnace having lengthwise, generally horizontal supports, said rider comprising:

an anchor-block secured to a said lengthwise, generally horizontal support; a cover block having a bottom-opening chamber adapted to receive said anchor-block; and locking means positioned between said anchor-block and a wall of said bottom-opening chamber;

hold-down means on said anchor-block and corresponding hold-down means in said bottom-opening chamber which are engagable to resist vertical movement of said cover-block;

a generally vertical transverse first bearing surface on said anchor-block and a generally vertical transverse second bearing surface within said bottom-opening chamber which are engagable to resist forward movement of said cover-block.

7. A heat-resistant rider according to claim 1 wherein said cover block comprises a block of heat-resistant steel and said anchor-block comprises a block of steel differing from that which comprises said cover block.

8. A heat-resistant rider for supporting a workpiece in a furnace having lengthwise, generally horizontal supports, said rider comprising:

an anchor-block having a base, a forward end, a rearward end and a top, said anchor-block being engagable with a said lengthwise support and adapted to be secured to a said lengthwise support; said forward end having top-lateral extensions, each defining forward generally horizontal first hold-down surfaces; a forward, top-recess between said extensions; said rearward end having a bottom, transverse recess defining two generally vertical bearing surfaces and a generally horizontal second hold-down surface;

a cover block which is wider, longer and higher than said anchor-block and which contains a bottom-opening chamber engagable with said anchor-block in covering relation wherein the bottom surface of said cover block is engagable with said lengthwise supports; said cover block being adapted to slide forwardly relative to said anchor-block into an operative position; said cover block chamber including inwardly extending lateral bosses adjacent said bottom surface, each having a generally horizontal upper surface engagable with said forward first hold-down surfaces; said cover block chamber also including a recess at its top, rearward portion engagable with the rearward end of said anchor-block to resist further forward movement of said cover block; said recess including a generally horizontal surface engagable with said horizontal second hold-down surface to resist vertical movement of said cover block away from said support;

locking means which are alternatively retained in (1) said top-recess of said anchor-block prior to installing said cover block and (2) in a rider locking chamber defined between said forward end of said anchor-block and the forward end of said cover block chamber;

and passageway means for moving said locking means from said top-recess to said locking chamber and from said locking chamber to said top-recess.

9. The rider of claim 8 wherein said locking means comprises a sphere.

10. The rider of claim 9 wherein said locking means comprises a sphere of magnetic metal.

11. The rider of claim 8 wherein said locking means comprises a cylindrical block.

* * * * *